US005667873A

United States Patent [19]

Beckenbach

[11] Patent Number: 5,667,873

[45] Date of Patent: Sep. 16, 1997

[54] PROTECTIVE FLOOR MAT FOR CARPET AND THE LIKE

[76] Inventor: Martin J. Beckenbach, 181 W. Shore Blvd., Newark, N.Y. 14513

[21] Appl. No.: 579,968

[22] Filed: Dec. 28, 1995

[51] Int. Cl.[6] ..... D06H 7/04

[52] U.S. Cl. ..... 428/141; D12/203; D6/582

[58] Field of Search ..... D2/962; 36/7.6, 36/7.7; D12/203; D6/582; 428/141

[56] References Cited

U.S. PATENT DOCUMENTS

| | | | |
|---|---|---|---|
| D. 105,159 | 6/1937 | Wilcox | D2/962 |
| 4,804,567 | 2/1989 | Reuben | 428/40 |

*Primary Examiner*—Christopher Raimund
*Attorney, Agent, or Firm*—Robert J. Bird

[57] ABSTRACT

A floor mat has an underside with a coarse matte finish and an array of truncated concave conoidal gripping protuberances extending downward from it for improved carpet penetration and improved resistance to movement on carpet.

2 Claims, 1 Drawing Sheet

PROTECTIVE FLOOR MAT FOR CARPET AND THE LIKE

FIELD OF THE INVENTION

This invention relates to anti-skid protective floor matting for use on carpeting and the like.

BACKGROUND AND INFORMATION DISCLOSURE

Floor mats of the type with which this invention is concerned are widely used as protective cover for carpets and the like. Such mats are typically placed in high traffic areas to protect underlying carpet, or in high load areas such as under a movable desk chair to facilitate rolling movement of the chair, or in a motor vehicle under the driver's feet. These mats are commonly made of vinyl or polyvinyl chloride (PVC).

The underside of a floor mat includes a multiplicity of cleats or grippers extending downward to engage the underlying carpet to thereby restrain the mat against slipping and sliding on the carpet. The grippers that I know of in the prior art are of hemispherical, or pyramidical, or convex conoidal, or cylindrical configuration. These prior art configurations are illustrated, left to right respectively, in FIG. 3.

SUMMARY OF THE INVENTION

A floor mat according to this invention has an underside with a coarse matte finish and an array of truncated concave conoidal gripping protuberances extending downward from it for improved carpet penetration and improved gripping for resistance to movement on carpet.

DRAWING

DESCRIPTION OF THE PREFERRED EMBODIMENT

Figure 1:
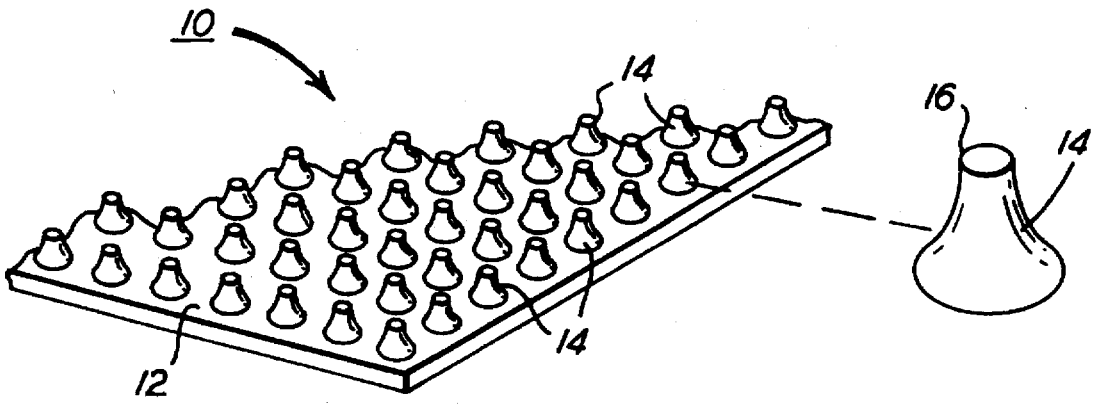
FIG. 1 is a partial pictorial view of the underside of floor matting according to my invention.

Referring to FIG. 1, a vinyl floor mat 10 has an underside 12 with an array of gripping protuberances 14 extending from the underside. The mat 10 in FIG. 1 is upside down for the sake of illustrating its underside 12. The top side, not shown, is not material to this invention. The underside 12 and the gripping protuberances 14 are preferably of a coarse matte finish.

Figure 2:
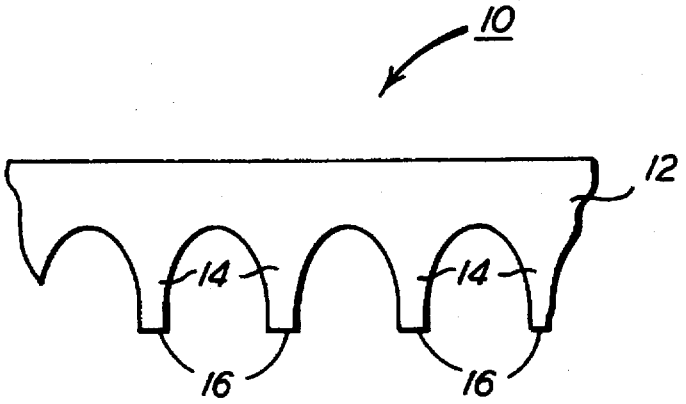
FIG. 2 is an enlarged edge view of a small portion of FIG. 1, inverted with its bottom down.

The protuberances 14 are shown in detail in FIG. 2. Each protuberance 14 is a truncated concave conoid. A conoid is a cone-like, or generally conical shape or surface. In other words, my conoids are cone-like spikes. A concave conoid is one with a uniformly concave configuration around its circumference. The conoids are preferably truncated so that their tips are not sharp and their bases are larger to support and provide strength to the spike. This is important for purposes of handling and for carpet protection.

Figure 3:
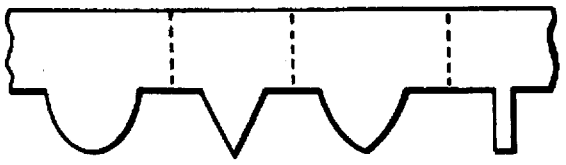
FIG. 3 (PRIOR ART)
FIG. 3 illustrates the three prior art gripper configurations discussed above.

The concave conoidal shape of the protuberances 14 is an improvement over the prior art grippers shown in FIG. 3. First, the concave shape penetrates carpet pile more easily and more effectively than do the prior art grippers, and it promotes conformity of the carpet pile to the conoidal shape of the protuberance. Second, the tip portions 16 of the protuberances 14 are vertical to more effectively prevent or resist movement on carpet. Prior art grippers, by comparison, effectively provide a multiplicity of inclined "ramp" surfaces which make it relatively easy to move a mat laterally over carpet. Third, the base of the conoid is larger, thus providing more strength to the spike. Finally, the coarse matte surface of the underside 12 and the protuberances 14 gives my mat improved frictional contact with carpet as compared with prior art grippers which are all smooth surfaced.

The foregoing description of a preferred embodiment of this invention including any dimensions, angles, or proportions, is intended as illustrative. The concept and scope of the invention are limited only by the following claims and equivalents thereof.

What is claimed is:

1. A floor mat having an underside with a coarse matte finish and an array of depending truncated concave conoidal gripping protuberances for improved carpet penetration and improved resistance to movement on carpet.

2. A floor mat having an underside with a coarse matte finish and an array of depending truncated concave conoidal gripping protuberances with vertical tip portions to enhance carpet penetration and resistance to lateral movement on carpet.

* * * * *